US006081948A

United States Patent [19]

Copeland

[11] Patent Number: 6,081,948

[45] Date of Patent: Jul. 4, 2000

[54] BREAST ORTHOTICS PILLOW

[75] Inventor: Jennifer B. Copeland, Chicago, Ill.

[73] Assignee: Isopedic Corporation, Chicago, Ill.

[21] Appl. No.: 09/286,229

[22] Filed: Apr. 5, 1999

[51] Int. Cl.[7] ..... A47G 9/00; A47C 20/02

[52] U.S. Cl. ..... 5/632

[58] Field of Search ..... 5/632, 630, 636, 5/646, 653, 735

[56] References Cited

U.S. PATENT DOCUMENTS

| | | | |
|---|---|---|---|
| D. 318,923 | 8/1991 | Marsh | D24/64 |
| D. 335,999 | 6/1993 | Van Driessche | D6/604 |
| 1,742,186 | 1/1930 | Claus | 5/653 |
| 2,835,905 | 5/1958 | Tomasson | 5/338 |
| 3,009,172 | 11/1961 | Eidam | 5/338 |
| 3,287,747 | 11/1966 | Ellsworth | 5/338 |
| 3,648,308 | 3/1972 | Greenwalt | 5/632 |
| 3,967,335 | 7/1976 | Rhoads | 5/338 |
| 4,288,879 | 9/1981 | Pate | 5/431 |
| 4,522,447 | 6/1985 | Snyder et al. | 5/653 |
| 4,949,411 | 8/1990 | Tesch | 5/434 |
| 5,095,569 | 3/1992 | Glenn | 5/490 |
| 5,103,516 | 4/1992 | Stevens | 5/632 |
| 5,153,960 | 10/1992 | Ritter et al. | 5/632 |
| 5,400,449 | 3/1995 | Satto | 5/631 |
| 5,412,824 | 5/1995 | Emerson et al. | 5/632 |
| 5,425,147 | 6/1995 | Supplee et al. | 5/453 |
| 5,426,798 | 6/1995 | Guarino | 5/461 |
| 5,638,564 | 6/1997 | Greenwalt et al. | 5/636 |
| 5,647,076 | 7/1997 | Gearhart | 5/632 |
| 5,652,981 | 8/1997 | Singer-Leyton et al. | 5/631 |
| 5,661,860 | 9/1997 | Heitz | 5/632 |
| 5,720,061 | 2/1998 | Giori et al. | 5/735 |

*Primary Examiner*—Alexander Grosz
*Attorney, Agent, or Firm*—Laff, Whitesel & Saret, Ltd.

[57] ABSTRACT

The present invention relates to a breast orthotics pillow having a head-and-arm rest portion with an open end, a cavity defined by the head-and-arm rest portion, and a core that fits within the cavity and is composed of a material more resilient than the head-and-arm rest portion. During use of the invention, a woman's breasts rest within and are received by the core. Preferably, the head-and-arm rest portion comprises a back and lateral branches and includes a resilient upper portion positioned directly over a less resilient lower portion, both the upper and lower portions, however, being less resilient than the breasts-receiving core.

12 Claims, 4 Drawing Sheets

BREAST ORTHOTICS PILLOW

FIELD OF THE INVENTION

This invention relates generally to a pillow. In particular, the pillow is intended to provide orthotic comfort and support to a woman's upper body, especially her breasts, while she is prone.

BACKGROUND OF THE INVENTION

It is often difficult for a woman to lie prone on her stomach because of the discomfort caused by having her breasts pressed against her upper body by the surface on which she is lying. The pressure applied by a relatively hard, non-conforming surface against the breasts may be particularly uncomfortable for women whose breasts are especially sensitive, such as women with breast implants, mastectomies, naturally full breasts or who are nursing.

There are pillows and mattresses that are currently available, particularly for pregnant women, that are intended to offer comfort to a woman lying prone by providing cavities or cut-outs in the surface of the mattress or pillow to receive a woman's abdomen and/or breasts. The breast-receiving cavities or cut-outs are configured to conform to a pre-selected "standard" of women's breasts and are not adjustable. This type of design does not provide the comfort and support created by the pillow of the present invention for several reasons. First, pre-formed cavities or cut-outs cannot account for the individual differences in the size and shape of women's breasts. In addition, these cavities or cut-outs do not provide means to support the breasts. As a result, breasts that are smaller than the size of the cavity would simply hang in the cavity, placing disproportionate pressure on the upper torso surrounding the breasts. Breasts larger than the size of the cavities would be compressed against the sides and/or bottom of the cavity or cut-out, thereby defeating the purpose of the cavity or cut-out.

Moreover, these mattresses and pillows do not include portions for comfortably receiving and supporting the arms, shoulders, neck and head of the user. In fact, most of these mattresses or pillows are planar so that the cavities or cut-outs accommodate the user's breasts only if she is lying completely flat; they would not accommodate the user's breasts if she has propped herself up on her elbows or forearms, for instance, to read or watch television.

Finally, these mattresses and pillows are typically either too large or bulky, or must be deflated, in order to be easily transported.

Accordingly, an object of this invention to provide an improved pillow that orthotically supports and cradles the breasts of a woman while she is lying prone.

It is another object of this invention to provide an improved pillow that eliminates the pressure applied against the breasts of the user while she is lying prone.

A further object of this invention is to provide an improved pillow that comfortably supports the arms, shoulders, neck and head of the user.

Yet another object is to provide an improved pillow that provides support to women with breasts of various shapes and sizes.

It is a further object of this invention to provide a pillow that allows the user to prop up her upper body while in the prone position but that keeps her breasts orthotically supported or cradled.

Another object of this invention is to provide a pillow that is configured and dimensioned so that it may be easily transported.

SUMMARY OF THE INVENTION

The present invention accomplishes the foregoing objectives by providing a pillow having a resilient yet supportive portion on which the user may rest her arms, shoulders, neck and head, an open end with which the user aligns her body, and a cavity filled with a soft and more resilient core that conforms to and cradles the breasts. The soft core is positioned on top of a sturdy platform so that the user's breasts are comfortably supported without having pressure applied against them. The portion of the pillow that supports the arms, shoulders, head, etc. of the user slopes upwardly which helps to the relieve pressure from the breasts. In addition, the slope allows the user to comfortably position her upper body in a slightly raised position for receiving a massage, for tanning, or for reading or watching television.

In the preferred embodiment of this invention, the pillow includes a generally horseshoe-shaped, head-and-arm rest portion and a generally rectangular core. The head-and-arm rest portion comprises an upper portion composed of a resilient foam that molds itself to the shape of the body and a lower portion composed of a less resilient foam. This combination of materials provides optimum comfort and support to the upper body.

DESCRIPTION OF THE FIGURES

The above as well as other objects and advantages of the invention will become apparent from the following detailed description of the preferred embodiments in which reference is made to the accompanying drawings in which.

DESCRIPTION OF PREFERRED EMBODIMENTS

FIGS. 1–4 depict the breast orthotics pillow 10 of the present invention defined by an upper, exposed surface 12 (FIG. 3) that receives the upper torso of the user and an oppositely-disposed bottom surface 14 (FIG. 4) that contacts the bed, floor, massage table or other surface on which the user is lying.

Figure 1:
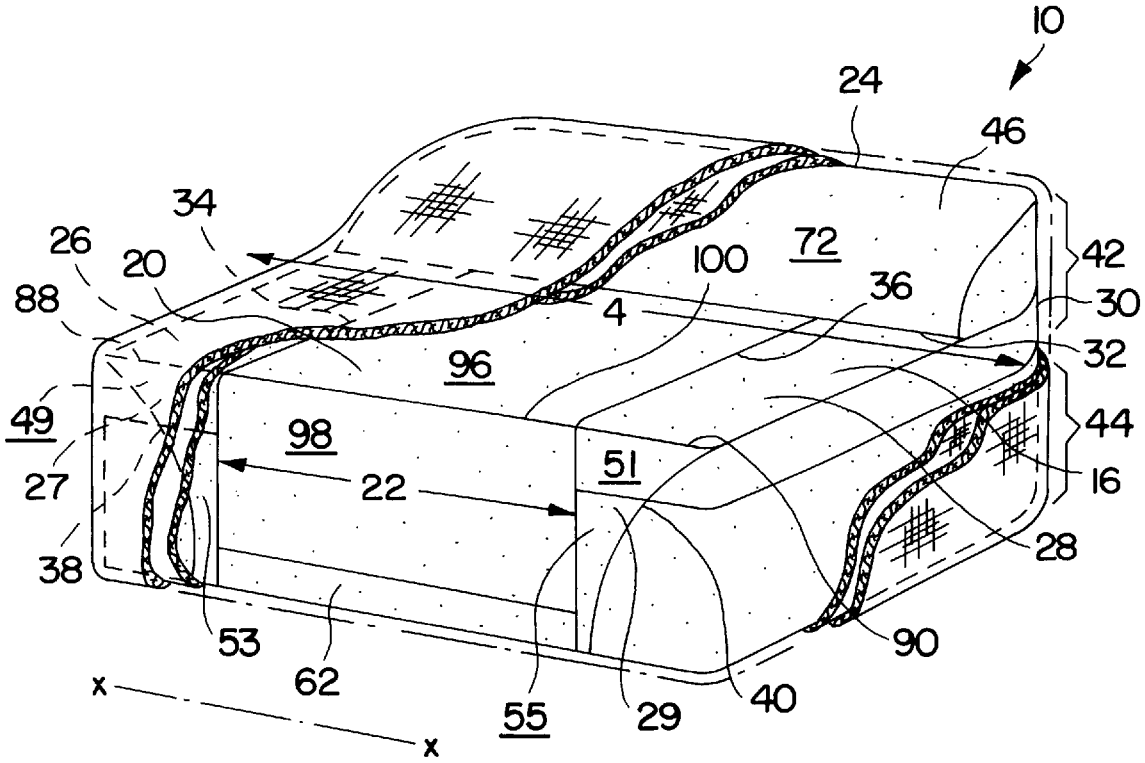
FIG. 1 is a perspective view of the breast orthotics pillow of the present invention with a decorative slipcover cut away to show a portion of the pillow.

FIG. 1 depicts a horseshoe-shaped, head-and-arm rest portion 16 that defines a cavity 18 (see FIG. 2) and a core 20 that is dimensioned and configured to fit securely within cavity 18. The head-and-arm rest portion has an open end 22. This horseshoe shape is the preferred embodiment for the head-and-arm rest portion; however, a head-and-arm rest portion with another configuration may also be used as long as it has an open end 22 that is wide enough to receive the upper torso of a woman. The head-and-arm rest portion is made of a resilient but sufficiently supportive material to support the head, neck, shoulders, arms, elbows and hands of the female user, while the core is made of a soft and more resilient material to receive and cradle the breasts of the user when the user is lying prone.

The head-and-arm rest portion 16 comprises a back 24 and two lateral branches 26 and 28. Back 24 and lateral branches 26 and 28 preferably have a rounded and continuous outer surface 30.

Lateral branches are identically configured and proportioned so that they are essentially mirror-images of each other. Head-and-arm rest portion 16 terminates in front surfaces 27 and 29 that are preferably smooth, flat and parallel to the horizontal axis "x" of the pillow.

Back 24 has inner surface 32, and lateral branches 26 and 28 have inner surfaces 34 and 36. In the preferred embodiment, these inner surfaces are planar and intersect at right angles. As a result, cavity 18 is preferably box-shaped having planar sides and open end 22. This configuration is preferred because it allows even full breasts to be placed in core 20 without any portion of the breasts contacting any part of the firm head-and-arm rest portion 16.

Referring now to FIG. 1, edges 38 and 40 are formed where rounded outer surface 30 meets front surfaces 27 and 29 respectively. Preferably these edges are curved and oriented diagonally from outer surface 30 towards core 20. Adjacent to core 20 and bottom surface 14 of the pillow, the angles defined by edges 38 and 40 are only slightly less than 180 degrees. This eliminates sharp jutting edges that may poke into and cause discomfort to the user.

Head-and-arm rest portion 16 comprises an upper portion positioned directly over a lower portion; where head-and-arm rest portion 16 has the preferred horseshoe-shaped embodiment, these portions comprise an upper horseshoe 42 and a lower horseshoe 44. Upper horseshoe 42 is composed of a moldable foam that will conform to the shape of the body part lying against it and will then reform to its original shape once the pressure is released. Lower horseshoe 44, on the other hand, is composed of a foam that is not as resilient and moldable as upper horseshoe 42.

Figure 2:
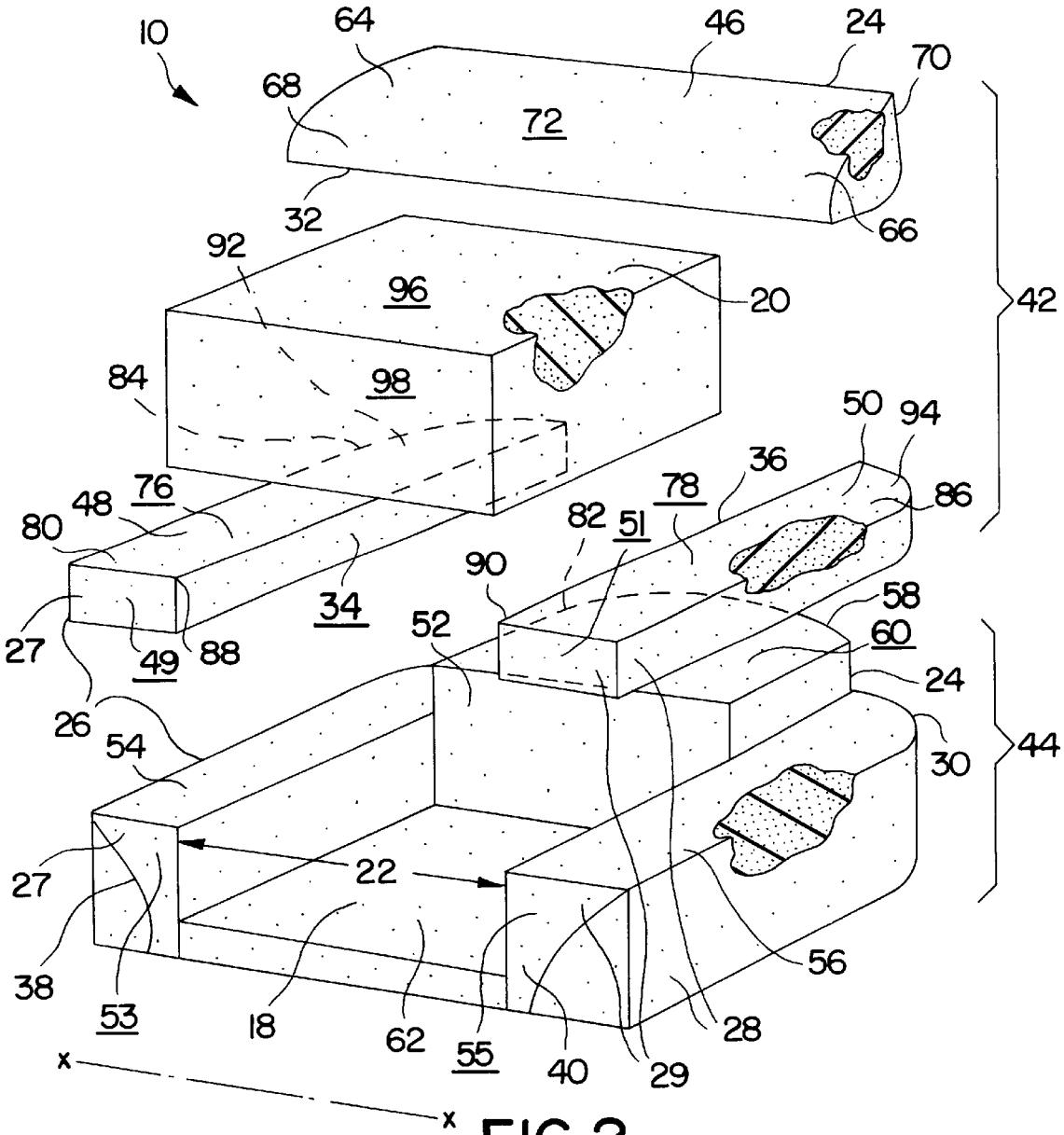
FIG. 2 is an exploded, perspective view of the breast orthotics pillow of the present invention.
Figure 3:
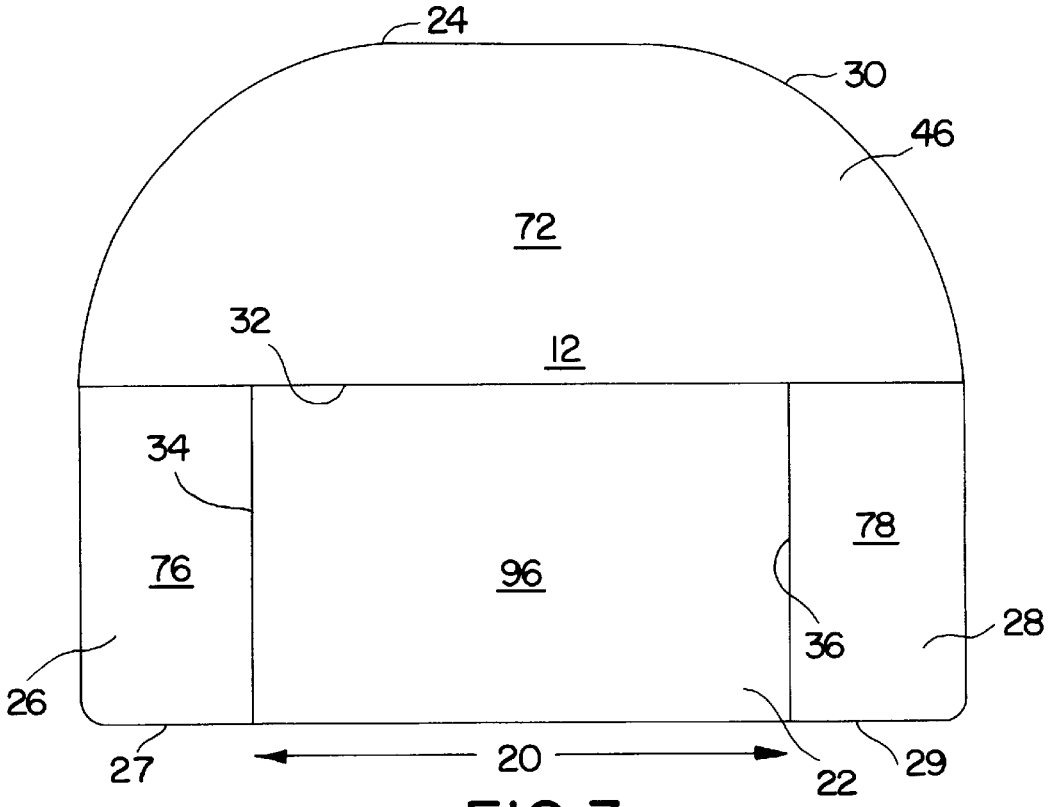
FIG. 3 is a plan elevation view of the top surface of the breast orthotics pillow of the present invention.
Figure 4:
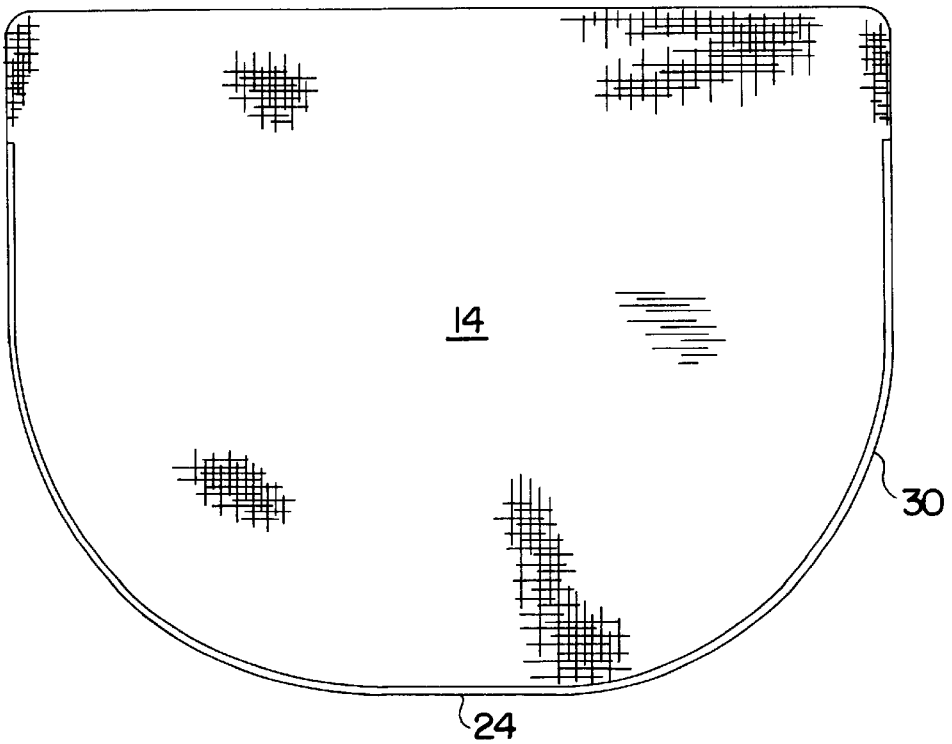
FIG. 4 is a plan elevation view of the bottom surface of the breast orthotics pillow of the present invention.

Referring now to FIG. 2, upper horseshoe 42 comprises a back wedge 46, and lateral branches 48 and 50 that terminate in front surfaces 49 and 51. Lower horseshoe 44 comprises a base 52 and lower lateral branches 54 and 56 that terminate in front surfaces 53 and 55. Preferably, front surfaces 49, 51, 53 and 55 are smooth and parallel to the horizontal axis "x" of the pillow. Upper horseshoe 42 is positioned directly over lower horseshoe 44 so that preferably, outer surface 30 and front surfaces 27 and 29 of the head-and-arm rest portion 16 are smooth. The height of the lower horseshoe is greater than the height of the upper horseshoe; preferably, the maximum height of the lower horseshoe is approximately two times greater than the height of the upper horseshoe.

Lower horseshoe 44 is preferably composed of Reflex Extra Plush foam having a density of 1.6 PCF with a plus or minus 0.1 PCF tolerance, and 40 ILD compression with a plus or minus 2.5 ILD tolerance.

Base 52 of lower horseshoe 44 has a rounded surface 58 at back 24 of the head-and-arm rest portion. Base 52 also includes planar surface 60 that abuts rounded surface 58 and faces towards upper surface 12 of the pillow. The height of base 52 is greater than the height of lower lateral branches 54 and 56; the difference in height corresponds to the height of upper lateral branches 48 and 50.

Lower horseshoe 44 also includes a seat 62 that is configured and dimensioned to define the bottom of cavity 18 and part of the bottom surface 14 of the pillow. In the preferred embodiment depicted, where cavity 18 is generally rectangular, seat 62 is generally rectangular also. Seat 62 is intended to function as a supportive platform on which the soft core will be placed. The seat prevents core 20 from bending or folding from the weight of a woman's breasts. In addition, seat 62 prevents the woman's breasts from being compressed by the surface underneath the pillow, without applying any pressure against the breasts.

Upper horseshoe 42 is preferably composed of Viscoelastic foam having a 3.3 PCF density with a plus or minus 0.1 PCF tolerance, and 15 ILD compression with a plus or minus 2.5 ILD tolerance. Viscoelastic foam is a temperature-sensitive material that molds itself to the shape of the body part pressing against it and becomes more pliable in response to body heat. Its slow-molding and highdensity characteristics spread pressure, reduce pressure points and reduce fatigue.

Upper horseshoe 42 includes a back wedge 46 having oppositely-disposed lateral flanks 64 and 66, a thin front edge 68, and a thick rounded edge 70 that lies along back 24 of the head-and-arm rest portion. Preferably, back edge 70 is approximately two times thicker than front edge 68. Front edge 68 and back edge 70 are connected by a sloping upper face 72.

In the present embodiment, as best seen in FIG. 1, front edge 68 lies along the horizontal axis "x" of the pillow and, preferably, along the horizontal midsection of the pillow.

Figure 5:
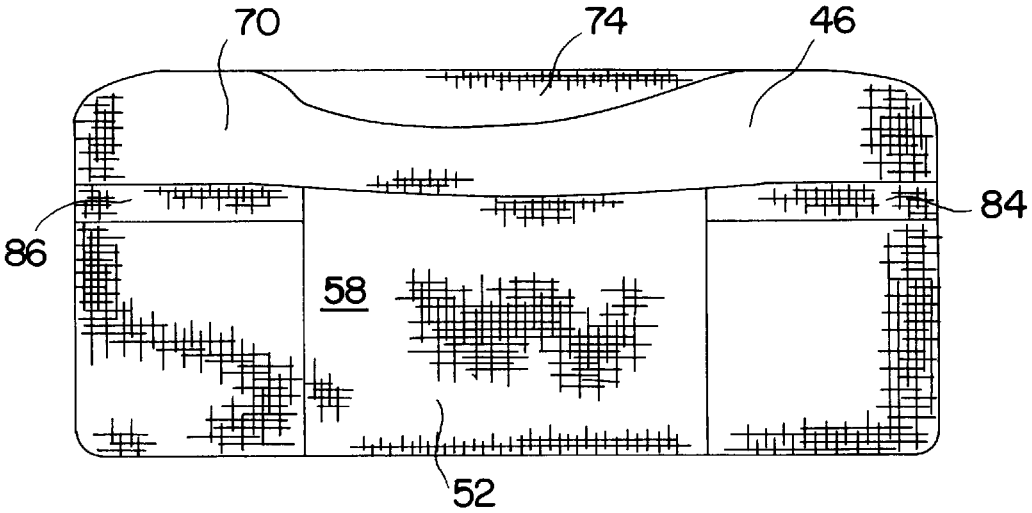
FIG. 5 is an elevation view of the front of the breast orthotics pillow of the present invention.

As best seen in FIG. 5., back edge 70 is preferably contoured to include a dip 74 preferably midway along the length of back edge 70. Dip 74 is integral with sloping upper face 72. Dip 74 provides an additional smooth surface on which the user can place her head, neck or chin without the discomfort that may result if it were suspended over back edge 70 of the pillow and, consequently, unsupported by the pillow. In addition, the height of upper horseshoe 42 at dip 74 is less than the height of the upper horseshoe at back edge 70. As a result, the ratio of the heights of Viscoelastic foam to the firmer Reflex foam is less at dip 74 than at back edge 70, thereby providing greater support to the portion of the head, neck or chin placed on the dip.

Referring now to FIGS. 1 and 2, upper lateral branches 48 and 50 of upper horseshoe 42 have upper surfaces 76 and 78 that form a smooth and continuous surface with sloping upper face 72 of back wedge 46. Upper surfaces 76 and 78 are also coplanar with planar surface 60 of base 52.

Figure 6:
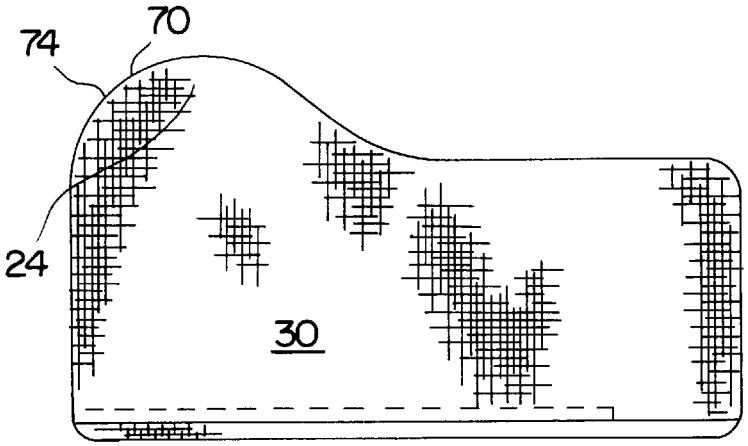
FIG. 6 is an elevation view of the side of the breast orthotics pillow of the present invention.
Figure 7:
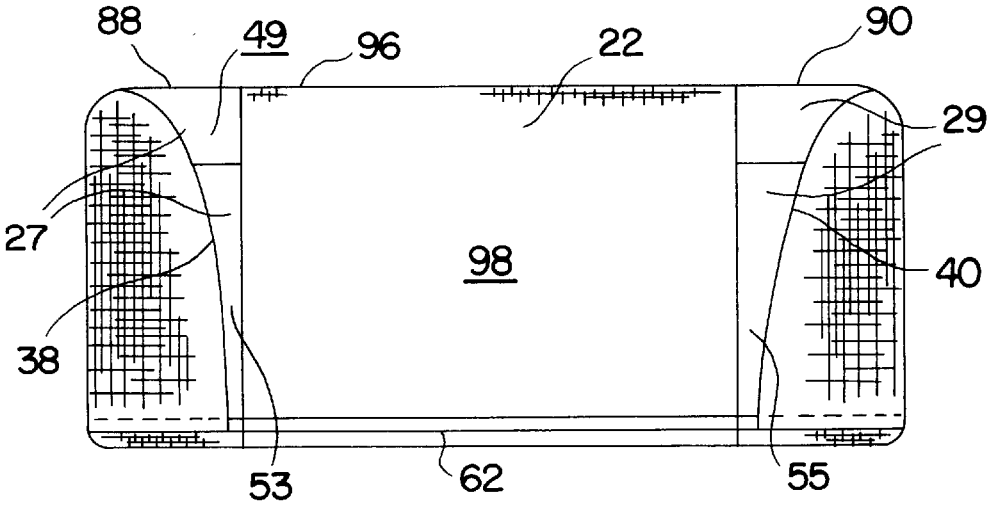
FIG. 7 is a elevation view of the back of the breast orthotics pillow of the present invention.

As a result, the profile of the pillow (see FIG. 6) smoothly and gently slopes upwardly towards back 24 of the head-and-arm rest portion 16. As seen in FIG. 2, upper surfaces 76 and 78 have front ends 80 and 82 that abut front surfaces 49 and 51 of the head-and-arm rest portion 16 and back portions 84 and 86 that are adjacent to back 24 of head-and-arm rest portion 16. Preferably, front portions 80 and 82 meet front surfaces 49 and 51 at rounded edges 88 and 90.

Back portions 84 and 86 of upper surfaces 76 and 78 are positioned directly beneath lateral flanks 64 and 66 of back wedge 46. Preferably, back portions 84 and 86 include cavities 92 and 94 that are configured and dimensioned to receive the lateral flanks of the back wedge. Alternatively, however, back wedge 46 is positioned directly over back portions 84 and 86 of the upper lateral branches and over upper surface 60 of base 52, as depicted in FIG. 2.

Because cavity 18 of the horseshoe-shaped head-and-arm rest portion is generally box-shaped, core 20 is also preferably generally box-shaped so that it fits securely within cavity 18. Preferably, the core is composed of Reflex Extra Soft foam having a density of 0.8 PCF with a plus or minus 0.1 PCF tolerance, and a compression of 6 ILD with a plus or minus 2.5 ILD tolerance.

Referring again to FIG. 1, core 20 has a planar upper surface 96 that is preferably parallel to upper surface 12 of the pillow and abuts lateral branches 26 and 28 of head-and-arm rest portion 16. Core 20 also has a front surface 98 that is preferably parallel to the horizontal axis "x" of the pillow and abuts the front surfaces 27 and 29 of head-and-arm rest portion 16. Upper surface 96 preferably meets front surface 98 at rounded edge 100.

Preferably, core 62 is configured and dimensioned so that when the core is positioned over seat 62 in cavity 18, upper surface 96 of the core is coplanar with upper surfaces 76 and 78 of the upper lateral branches, rounded edge 100 of the core is coplanar with the rounded edges 88 and 90 of the upper lateral branches, and the front surface 98 of the core is coplanar with the flat front surfaces 27 and 29. In this embodiment, all adjoining surfaces of the assembled pillow are smooth and continuous to enhance the ease and comfort of use.

The design and features of the pillow of the present invention allow it to be used in a variety of positions while maintaining optimum support and comfort the user. In all positions, the user lies prone and positions her body so that the upper torso adjacent to her breasts is aligned with open end 22 of the pillow. In the resting position, which may be employed when the user is tanning or receiving a massage, the user may lie prone on her stomach, place her breasts within core 20 of the pillow, rest her head, neck and shoulders on sloping upper face 72 of back wedge 46, and place her upper arms on upper surfaces 76 and 78 of upper lateral branches 48 and 50. In this position, the user's elbows comfortably bend over the rounded edges 88 and 90. The user may place her forearms to her side or around outer surface 30 of the head-and-arm rest portion 16 of the pillow. The rounded and continuous nature of outer surface 30 enhances the comfort experienced when the user is "hugging" the pillow in this manner.

Other positions allow the user to read or watch TV while keeping her breasts braced and cushioned within core 20. The user can prop up her upper torso by placing one or both elbows on lateral branches 26 and 28 adjacent to front surfaces 27 and 29 and resting her forearms and hands along upper surfaces 76 and 78 and sloping upper face 72 of back wedge 46. Alternatively, the user may turn to her side, stretch one of her upper arms along one of the upper surface of one of the lateral branches, place her elbow along upper sloping face 72 of back wedge 46, and rest her head in her hand.

Alternate embodiments of the present invention as described above are also viable.

For instance, inner surface 32 of back 24 and inner surfaces 34 and 36 of lateral branches 26 and 28, respectively, need not be planar surfaces that intersect at right angles. These inner surfaces may be rounded as long as they form an open end that is wide enough to accommodate the upper torso of a woman. Consequently, cavity 18, core 20 and seat 62 may be of any shape that results from the configuration of inner surfaces 32, 34 and 36, such as a semi-circle, as long as the cavity and core are large enough to comfortably accommodate a woman's breasts without any portion of the breasts contacting the less resilient head-and-arm rest portion.

Front surfaces 27 and 29 of the head-and-arm rest portion need not be smooth, flat and parallel to the horizontal axis "x" of the pillow. The surfaces of the heels may be offset in either direction from the horizontal axis of the pillow, may be convex surfaces or concave surfaces, or may be flat surfaces containing ribs, depressions or some other kind of texturing.

Nor does outer surface 30 need meet front surfaces 27 and 29 at inwardly curved and tapered edges 38 and 40; alternatively, edges 38 and 40 may be straight and form generally right angles that do not taper.

Upper horseshoe and lower horseshoe need not have the identical sizes; instead, for example, one horseshoe may be larger than the other so that, when assembled together, the contour of one protrudes beyond the other. Although the maximum comfort and support is achieved by having the height of lower horseshoe approximately two time greater than the upper horseshoe, the difference in the heights may be greater or less than the preferred ratio or, alternatively, the heights may be equal.

In the preferred embodiment, back wedge 46 includes a back edge 70 that is approximately two times thicker than front edge 68, the two edges connected by sloping upper face 72. The difference in thickness between the two edges, however, may be either greater or less than the preferred ratio, which will result in a more or less dramatic slope.

Front edge 68 may comprise a straight line that lies along or is offset from the horizontal axis "x" of the pillow; alternatively, the front edge may be some other shape, such as a convex or concave curve.

In the preferred embodiment, upper surfaces 76 and 78 of upper lateral branches 48 and 50 meet the flat front surfaces 49 and 51 at rounded edges 88 and 90; alternatively, however, these edges may comprise generally right angles.

Those who are skilled in the art will readily perceive how to modify the invention. Therefore, the appended claims are to be construed to cover all equivalent structures which fall within the true scope and spirit of the invention.

What we claim is:

1. A breast orthotics pillow adapted to support the head, arms and breasts of a prone female comprising:

a head-and-arm rest portion having an open end defining a cavity, and a core that fits within the cavity and is composed of a material more resilient than said head-and-arm rest portion, said core for supporting a woman's breasts, the head-and-arm rest portion and the core defining a generally planar upper surface.

2. The breast orthotics pillow of claim 1 in which the head-and-arm rest portion comprises a back and lateral branches.

3. The breast orthotics pillow of claim 2 in which the lateral branches are identically configured.

4. The breast orthotics pillow of claim 1 in which the cavity has a generally rectangular cross section.

5. The breast orthotics pillow of claim 1 wherein the head-and-arm rest portion comprises an upper portion positioned directly over a lower portion.

6. The breast orthotics pillow of claim 5 wherein the upper portion is made of a resilient foam and the lower portion is made out of a less resilient foam.

7. The breast orthotics pillow of claim 1 in which a portion of the head-and-arm rest portion slopes upwardly.

8. A breast orthotics pillow adapted to support the head, arms and breasts of a prone female comprising:

a head-and-arm rest portion comprised of a back and lateral branches, said head-and-arm rest portion including an upper portion positioned directly over a lower portion, said head-and-arm rest portion defining a cavity, a core that fits within the cavity, the head-and-arm rest portion and the core defining a generally planar upper surface, wherein the upper portion is composed of a resilient foam, the lower portion is composed of a foam less resilent than said upper portion, and the core is composed of a material more resilient than said upper portion.

9. The breast orthotics pillow of claim 8 in which the lower portion has a height that is approximately two times greater than the height of the upper portion.

10. The breast orthotics pillow of claim 8 in which the lower portion includes a seat that defines the bottom of the cavity and part of a bottom surface of the pillow.

11. The breast orthotics pillow of claim 8 in which the upper portion includes a back wedge, the back wedge having a front edge and a back edge, the height of the back edge being approximately two times greater than the height of the front edge.

12. The breast orthotics pillow of claim 11 in which the front edge lies horizontally along approximately a midsection of the pillow.

* * * * *